US007484712B2

(12) United States Patent
Hossler

(10) Patent No.: US 7,484,712 B2
(45) Date of Patent: Feb. 3, 2009

(54) HOIST ASSEMBLY

(75) Inventor: Brad Hossler, Tiffin, OH (US)

(73) Assignee: Tiffin Scenic Studios, Inc., Tiffin, OH (US)

( * ) Notice: Subject to any disclaimer, the term of this patent is extended or adjusted under 35 U.S.C. 154(b) by 0 days.

(21) Appl. No.: 11/421,616

(22) Filed: Jun. 1, 2006

(65) Prior Publication Data

US 2006/0284151 A1 Dec. 21, 2006

Related U.S. Application Data

(60) Provisional application No. 60/686,246, filed on Jun. 1, 2005.

(51) Int. Cl.
*B66D 3/04* (2006.01)

(52) U.S. Cl. ..... 254/331; 254/393; 254/413

(58) Field of Classification Search ..... 254/329, 254/331, 373, 388, 390, 393, 394, 398, 413
See application file for complete search history.

(56) References Cited

U.S. PATENT DOCUMENTS 4,061,311 A * 12/1977 Yamasaki et al. ..... 254/331
4,062,519 A * 12/1977 Jacobs ..... 160/331
4,334,670 A * 6/1982 Kawabe ..... 254/346
4,347,680 A * 9/1982 Kaestner ..... 43/10
5,106,057 A * 4/1992 Feller et al. ..... 254/334
5,361,565 A * 11/1994 Bayer ..... 254/292
6,520,485 B1 2/2003 Soot
6,634,622 B1 10/2003 Hoffend, Jr.
6,691,986 B2 * 2/2004 Hoffend, Jr. ..... 254/394
7,364,136 B2 4/2008 Hossler
2007/0181862 A1 8/2007 Hossler

FOREIGN PATENT DOCUMENTS

EP 1038561 A2 9/2000
GB 2348151 A 9/2000

OTHER PUBLICATIONS

Web page—Big Tow Winches.
Brochure—Big Tow 2 Winches.

* cited by examiner

*Primary Examiner*—Emmanuel M Marcelo
(74) *Attorney, Agent, or Firm*—Barnes & Thornburg LLP; Alice O. Martin

(57) ABSTRACT

A hoist assembly for raising and lowering a load attached to a cable having a drum with a groove spirally disposed about its outer surface mounted within a frame. The groove having a predetermined pitch and configured to receive the cable wound about the drum. The drum has a cable take-off point where the cable ceases contacting the drum and is tangent to the drum. A head block is mounted to the frame and configured to receive the cable as it wound and unwound on the drum while maintaining tangential alignment with said take-off point.

10 Claims, 7 Drawing Sheets

HOIST ASSEMBLY

RELATED APPLICATION

This application claims the benefit of co-pending U.S. Provisional Application Ser. No. 60/686,246 filed Jun. 1, 2005.

BACKGROUND

The present disclosure relates to a hoist assembly. More particularly, the present disclosure relates to a hoist assembly that can be used to raise and lower a load, specifically in a theatrical setting.

Live performances in a theater typically employ a number of curtains and backdrops to convey to the audience different settings, environments, moods, and the like. These curtains and backdrops must be changed throughout the course of a performance within a fairly short timeframe without interrupting the performance. Typically this is done by raising a particular backdrop above the stage and out of sight of the audience when it is not being used. When a particular backdrop is needed, it is lowered into place on the stage.

Theatrical backdrops and curtains are typically suspended from battens, which are pipes or trusses that span the width of the stage. Battens can be 50 feet or more in length, depending on the size of the stage. As should be apparent, the weight of the battens and the items suspended from them can have substantial weight. More power is required the heavier the load being raised or lowered. Counterweights are employed to balance the load of the batten and its associated load. Battens and their associated counterweights are manually lifted and lowered. In these types of systems, a rope is tied to a counterweight and the batten is manually raised or lowered, then tied off to a pin rail mounted to a wall adjacent the stage area. However, if the load is not closely balanced, excessive energy may be required to move the load, or the system may get out of control, dropping the load or the counter-weight, causing injury, death and/or collateral damage.

Typical motorized hoists and winches have a grooved drum for winding and unwinding the cable attached to the battens. The cable leaves the drum and passes over one or more sheaves to change the orientation of the cable from the drum to the batten. The angle at which the cable pays off the drum is the fleet angle, defined as the angle between the centerline of the groove on the drum and the cable coming off the drum. The fleet angle should be kept to a minimum because increasing the fleet angle results in increased wear on the cable and drum. Therefore it is desirable to minimize the fleet angle to prolong cable and drum life.

SUMMARY

The present disclosure is for a hoist assembly for raising and lowering a load, especially in a theater or about a stage environment. The present disclosure provides a modular hoist that can be adapted to various configurations. Furthermore, the hoist of the present disclosure provides for a compact arrangement allowing for installation in places where space is limited.

The hoist is used for raising and lowering a load having a frame with a gear motor mounted thereon, a drive shaft coupled to the gear motor, a drum attached to the drive shaft, with at least one cable wound about the drum and a head block for receiving the cable as it leaves the drum maintained in position to be substantially aligned with the cable take-off point.

Additional features and embodiments will become apparent to those skilled in the art upon consideration of the following detailed description of drawings.

BRIEF DESCRIPTION OF THE DRAWINGS

The present disclosure will be described hereafter with reference to the attached drawings which are given as a non-limiting example only, in which.

DETAILED DESCRIPTION

Figure 1:
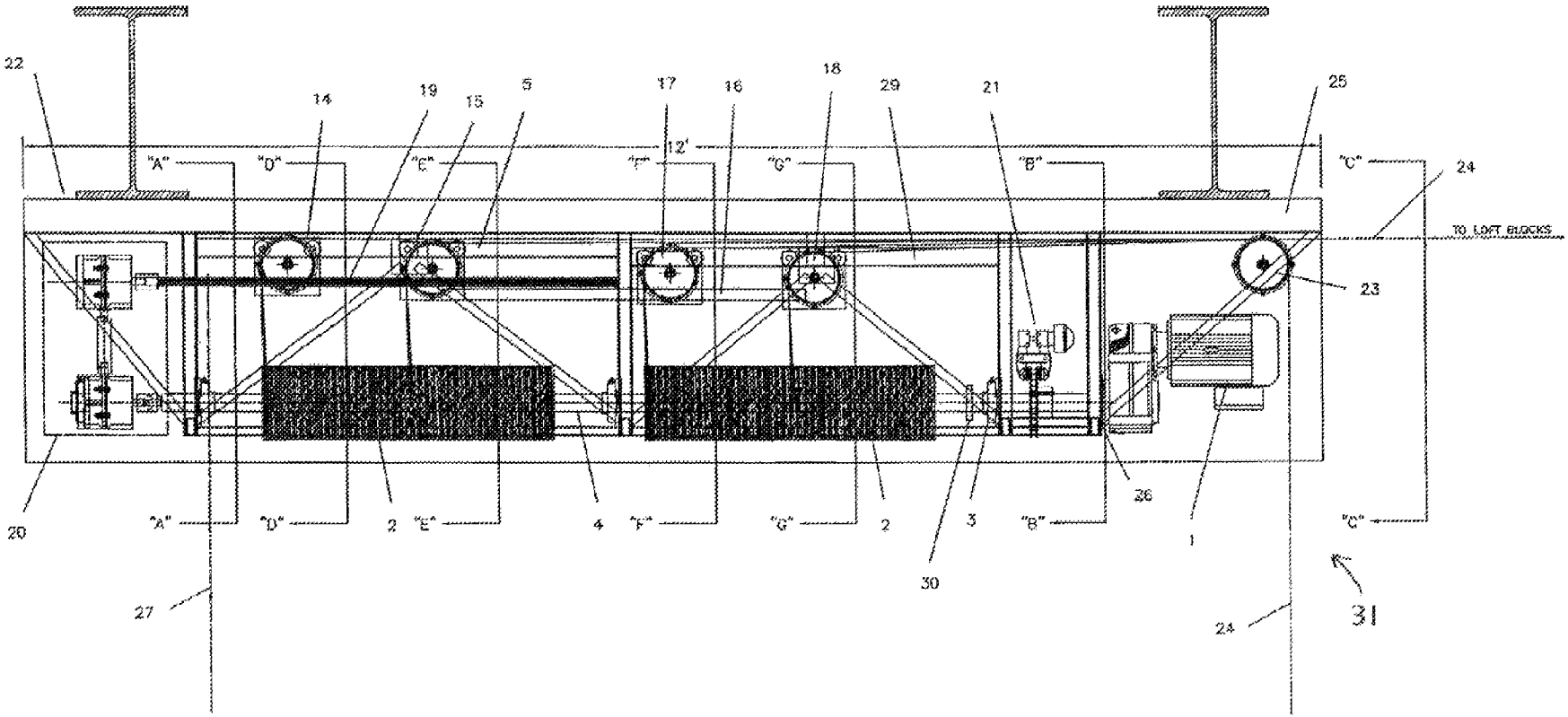
FIG. 1 is an elevation view of the hoist of the present disclosure.

The present disclosure relates to a hoist assembly for raising and lowering theater and stage scenery, lighting, and drapery. An embodiment of the present disclosure is mounted to structural support members above the stage area. In FIG. 1, the structural members are shown as I-beams supporting the building roof above the stage. The hoist 31 of the present disclosure is attached to the building structural members by mounting brackets 22 attached to the support frame 25. In the embodiment shown, the mounting brackets 22 are bolted to the structural members, although any means of attachment know in the art is acceptable.

An embodiment of the present disclosure has a support frame 25 for the components of the assembly. The frame is composed of a number of support members forming a truss structure for mounting the components of the assembly. A first head block guide track 5, and second head block guide track 29 are attached to the upper portion of the frame. In this embodiment, each guide track is formed from a pair of tubular steel members 5*a*, 5*b* and 29*a*, 29*b* respectively. The guide tracks are positioned horizontally in the direction of the long axis of the assembly and offset to one side of the drum as shown generally in FIGS. 8 through 14. In the embodiment shown, the truss is generally of a box-type truss although it is within the scope of the present disclosure for the frame to be of any suitable configuration.

Figure 9:
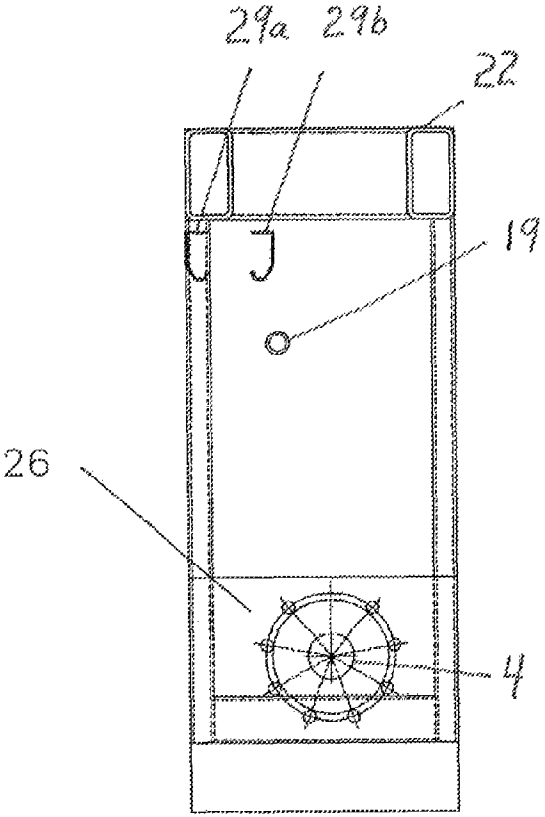
FIG. 9 is a section view taken at B-B showing the gear motor mounting bracket.
Figure 8:
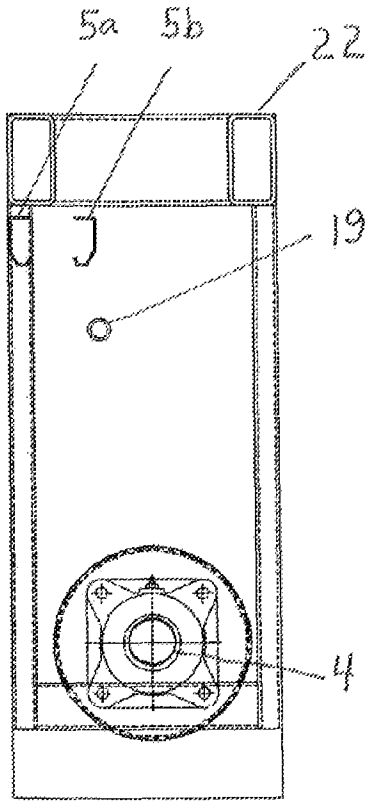
FIG. 8 is a section view taken at A-A showing the aft flange bearing for supporting the drive shaft
Figure 14:
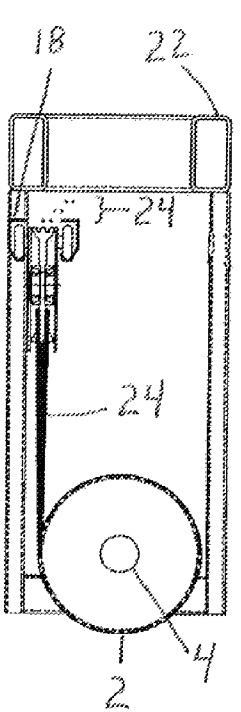
FIG. 14 is a section view taken at G-G showing the position of a second trailer head block.
Figure 13:
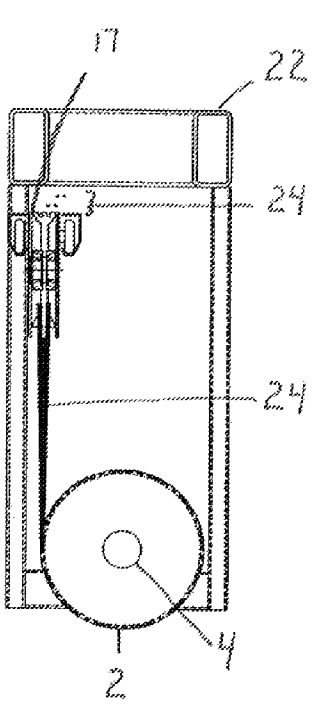
FIG. 13 is a section view taken at F-F showing the position of a first trailer head block.
Figure 12:
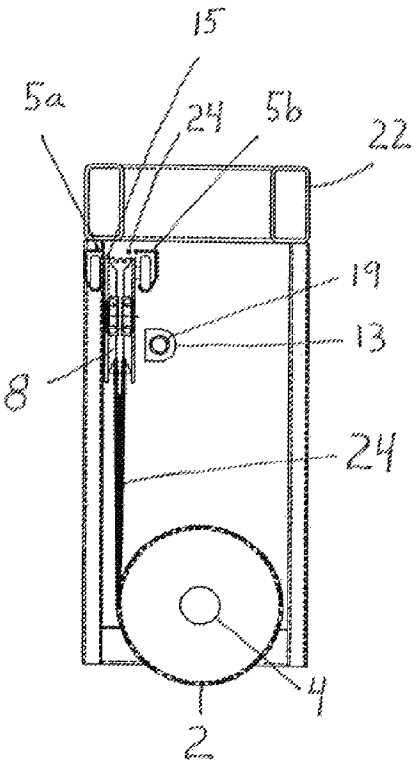
FIG. 12 is a section view taken at E-E showing the position of a drive/hitch head block.
Figure 11:
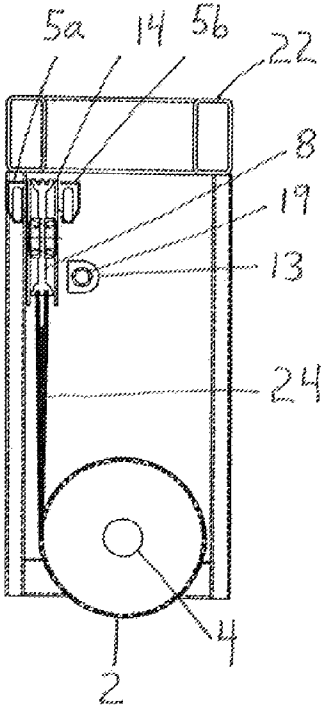
FIG. 11 is a section view taken at D-D showing the position of a drive head block.

A gear motor 1 is located at one end of the support frame 25. The gear motor 1 is attached to the frame 25 by a gear motor mounting bracket 26. The gear motor mounting bracket 26 shown is a steel plate attached to the support frame 25 as shown in FIG. 9. The gear motor is a combination of an electric motor and a gear reducer as is commonly known in the art.

The gear motor 1 is coupled to a drive shaft 4 which drives one or more wrap-up drums 2. The drum 2 receives lifting cables 24 that are attached to the load for raising and lowering. The drum 2 has a double score, that is, a pair of grooves wherein two cables 24 are wound about the drum 2 such that the pair of cables wind and unwind together. The grooves are configured in a spiral arrangement about the outer surface of the drum, and therefore having a predetermined pitch along the length of the drum. Multiple pairs of cables 24 may be wound about a drum 2 depending on the size of the drum and the weight of the load to be raised and lowered.

In an embodiment of the present disclosure, the drum may be constructed from typical 8 inch schedule 80 steel pipe. The pipe is machined to an 8½ inch outside diameter with the double grooves having a pitch diameter of 8⁵⁄₁₆ inch. The grooves are machined 2 grooves per inch with a pitch of ½ inch. Galvanized steel cables ³⁄₁₆ inch in diameter are wound about the drum and travel at speeds approaching 200 to 300 feet per minute. As should be apparent, proper cable size selection is dependent on the total load and number of cables and is intended to be exemplary and in no way limiting with respect to the scope of the disclosure.

The embodiment of the disclosure shown in FIG. 1 shows two wrap-up drums 2. However, it should be apparent to one skilled in the art that the present disclosure may embody a single drum or multiple drums depending on the number of cables required to accommodate the length and weight of the load, space availability, and other factors related to a particular installation. Furthermore, it is also within the scope of the present disclosure to have two or more hoist assemblies wherein the gear motors are synchronized to each other via an electronic controller. These features allow for a modular design that may be adapted to particular applications.

Figure 3:
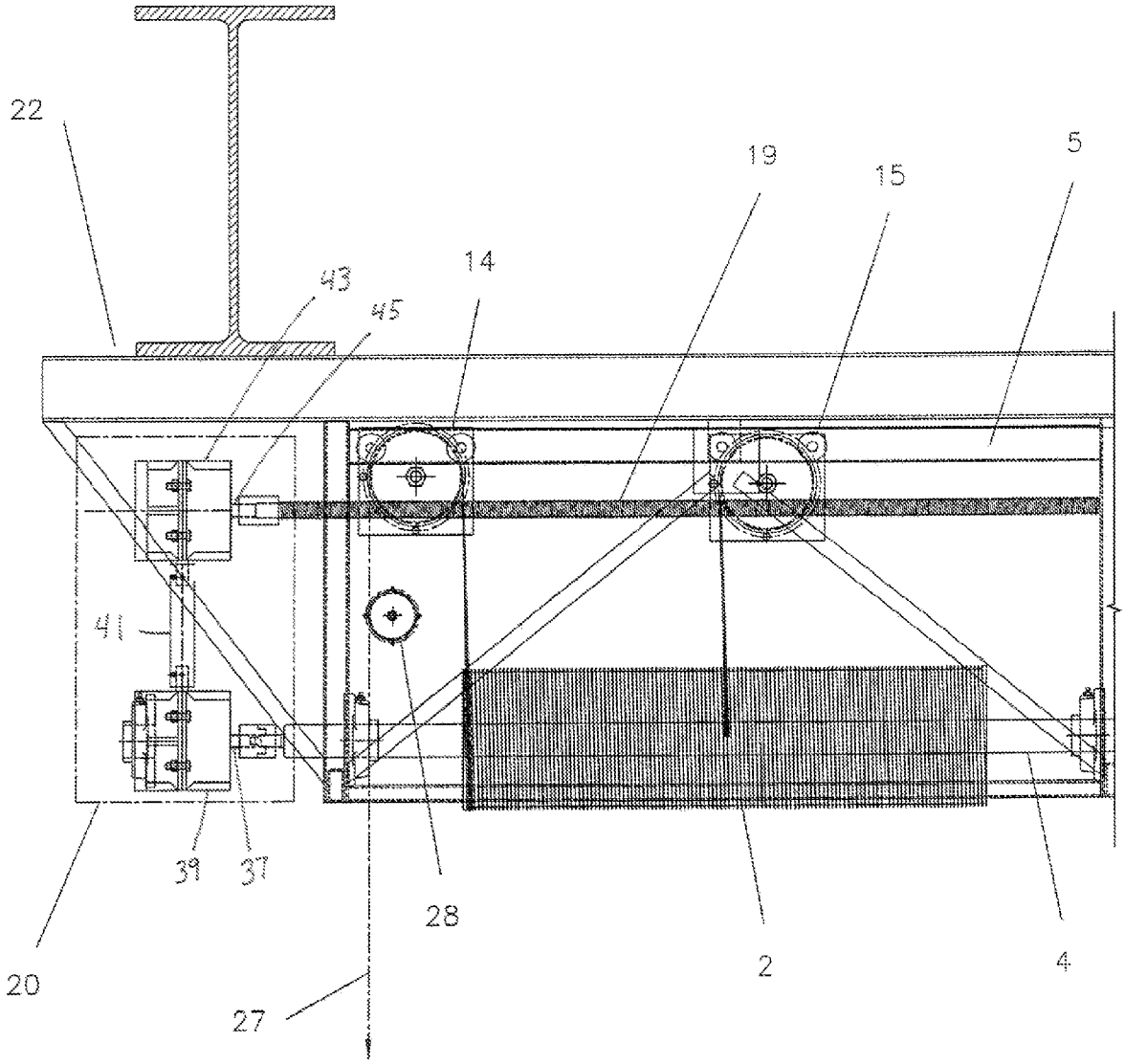
FIG. 3 is a detailed view of an alternate embodiment of the drum and head block arrangement of the hoist of FIG. 1.
Figure 5:
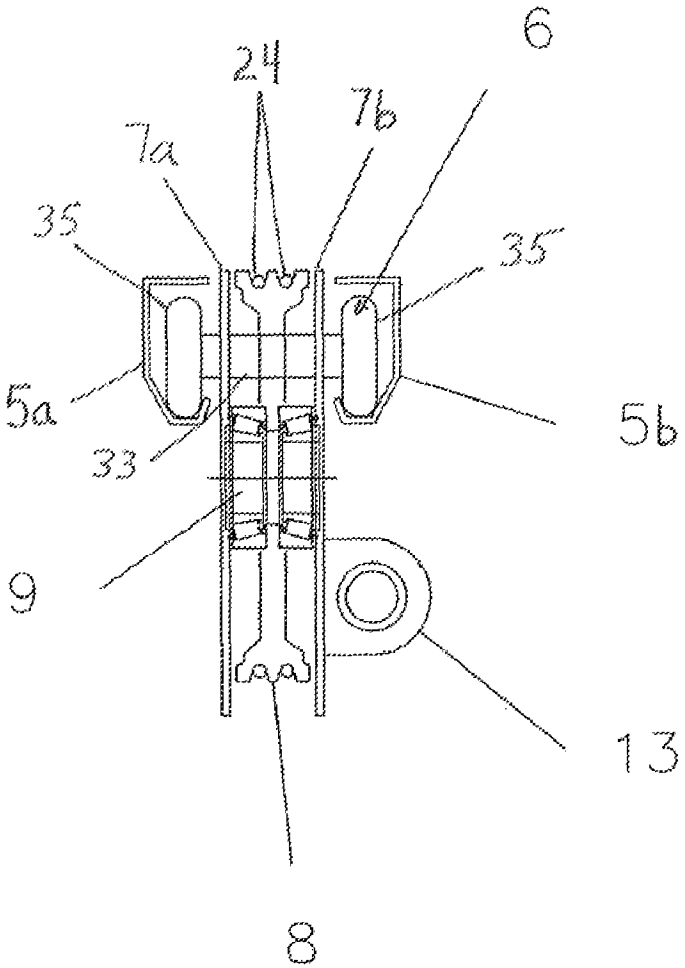
FIG. 5 is a front elevation view of the housing of FIG. 4.

A head block housing drive assembly 20 is attached to the end of the shaft 4 opposite to the gear motor 1. As shown in FIG. 3, the drive assembly 20 takes the rotation of the drive shaft 4 and transmits the rotational motion to a drive screw 19. At the take-off point, the cable 24 is tangent to the drum 2. The drive screw 19 has the same pitch as the drum 2 and drives the head block housings 14, 15 to substantially align head blocks 14, 15 with the cable take-off points on the drum 2.

Head block housing drive assembly 20 has an input shaft 37 coupled to the drive shaft 4 at the shaft end of the hoist assembly 31. The input shaft 37 drives a first differential 39, which transfers the rotational motion of the drive shaft 4 to an intermediate shaft 41. The intermediate shaft 41 is coupled to a second differential 43. The second differential 43 drives an output shaft 45 coupled to the head block drive screw 19. The first and second differentials 39, 43 each have a 1:1 gear ratio to maintain the same rotation between the drive shaft 4 and drum 2 and the head block drive screw 19. However, it should be apparent to one skilled in the art that the gear ratio of the head block housing drive assembly 20 may be varied as long as the pitch of the head block drive screw 19 is also adjusted such that the head blocks are aligned with the take-off points during operation.

For example, in the embodiment shown, the drum 2 has two grooves per inch for receiving lifting cables 24 with a pitch of ½ inch. For each drum revolution, the cable take-off point moves 1 inch. Therefore, to minimize the fleet angle, the head blocks are moved by the thread of the drive screw 19 to correspond with the cable take-off points. By minimizing the fleet angle in this manner results in reduced wear on the cable.

Figure 2:
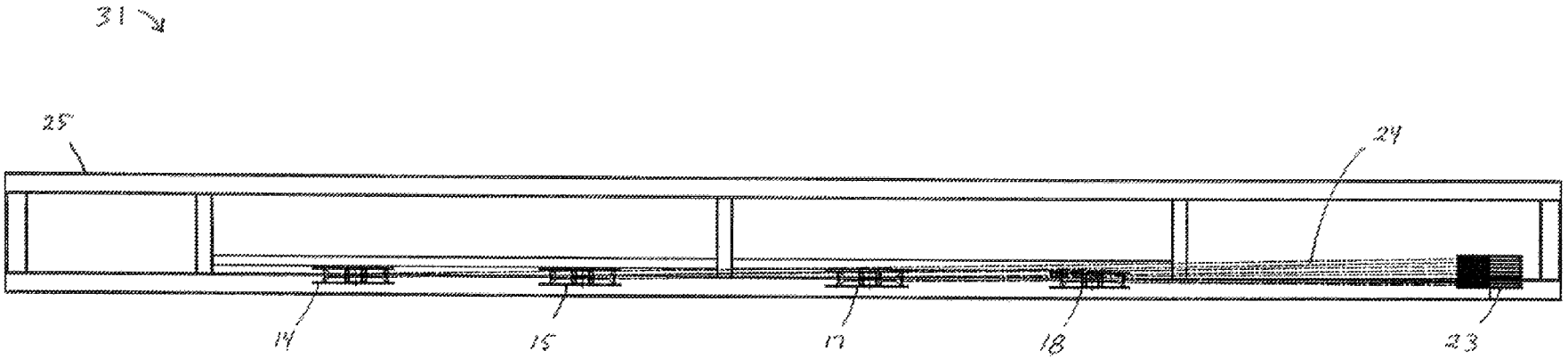
FIG. 2 is a plan view of the frame and head block arrangement of the hoist of FIG. 1.

The head blocks 14, 15, 17, and 18 are aligned horizontally but positioned in a vertically stepped arrangement to avoid interference between the cables 24. As shown in the embodiment of FIG. 1, head block 14 at the aft end of the hoist assembly 31 is positioned with its sheave at the greatest distance above the drum. The sheave of head block 15 is positioned lower than head block 14. Head blocks 17 and 18 are also positioned progressively lower. FIG. 2 shows a top plan view of the head block arrangement. Head blocks 14, 15, 17, and 18 are aligned with the cables 24 guided to master head block 23.

As shown in FIG. 1, head blocks 14 and 15 are mounted in a first head block guide track 5 while head blocks 17 and 18 are mounted in a second head block guide track 29 positioned slightly lower than the first guide track 5. It should be apparent that single or multiple guide tracks are within the scope of the present disclosure Referring to FIGS. 4 through 7, the head block housings 14, 15, 17, 18 generally comprise a first side plate 7*a* and a second side plate 7*b*. In the embodiment shown, side plates 7*a*, 7*b* are made of 11 gauge steel, although plates of other thicknesses and materials may be employed and still be encompassed by the scope of the present disclosure. The side plates 7*a*, 7*b* are generally parallel, spaced apart horizontally. Spacer bolts 11, 12 join side plates 7*a*, and 7*b* while maintaining the spacing between the side plates. Additionally, spacer bolt 11 acts as a cable "keeper" maintaining lifting cable 24 within the head block.

A head block shaft 10 extends between the first and second side plates 7*a*, 7*b*. Mounted to the head block shaft 10 is a bearing assembly 9 which allows a sheave 8 to rotate about the head block shaft 10.

The sheave 8 has a first groove and a second groove. The grooves in the sheave receive lifting cables 24 as they leave the drum 2 and redirect the lifting cables from a generally vertical orientation to a generally horizontal orientation. Although the embodiment shown depicts a double-grooved sheave having both grooves at the same distance from the sheave center, it should be understood that a dual-diameter sheave having grooves at different distances is also within the scope of the present disclosure. The dual-diameter sheave allows the two cables to be positioned relative to each other and the other components to minimize interference with the cables.

A head block guide 6 is attached to each head block housing 7. In the embodiment shown, the head block guide 6 includes a front wheel assembly and a rear wheel assembly. Each of the front and rear wheel assemblies are attached to the head block by an axle 33 that extends through the first and second side plates 7*a*, 7*b*. A ball bearing wheel 35 is attached to each end of the axle. The ball bearing wheels 35 cooperate with the head block guide tracks 5 and 29 to allow the head block to move back and forth along the head block guide track.

Figure 4:
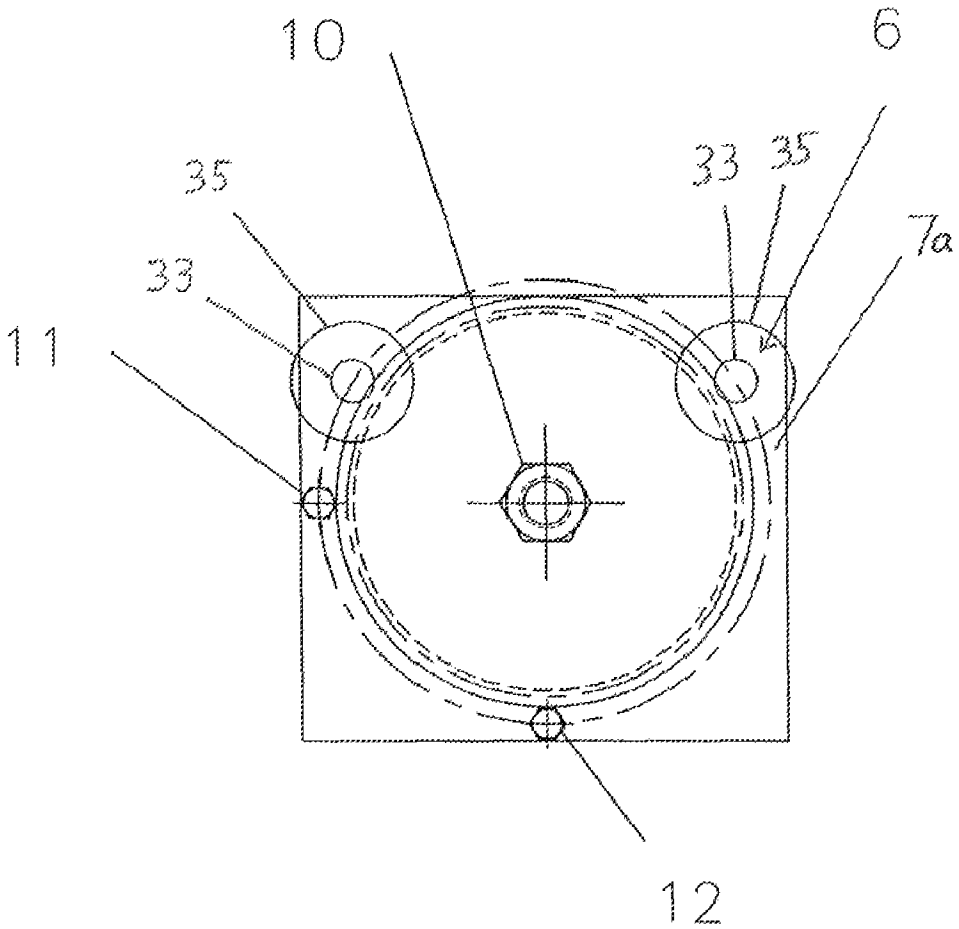
FIG. 4 is a side elevation view of a drive head block housing.
Figure 7:
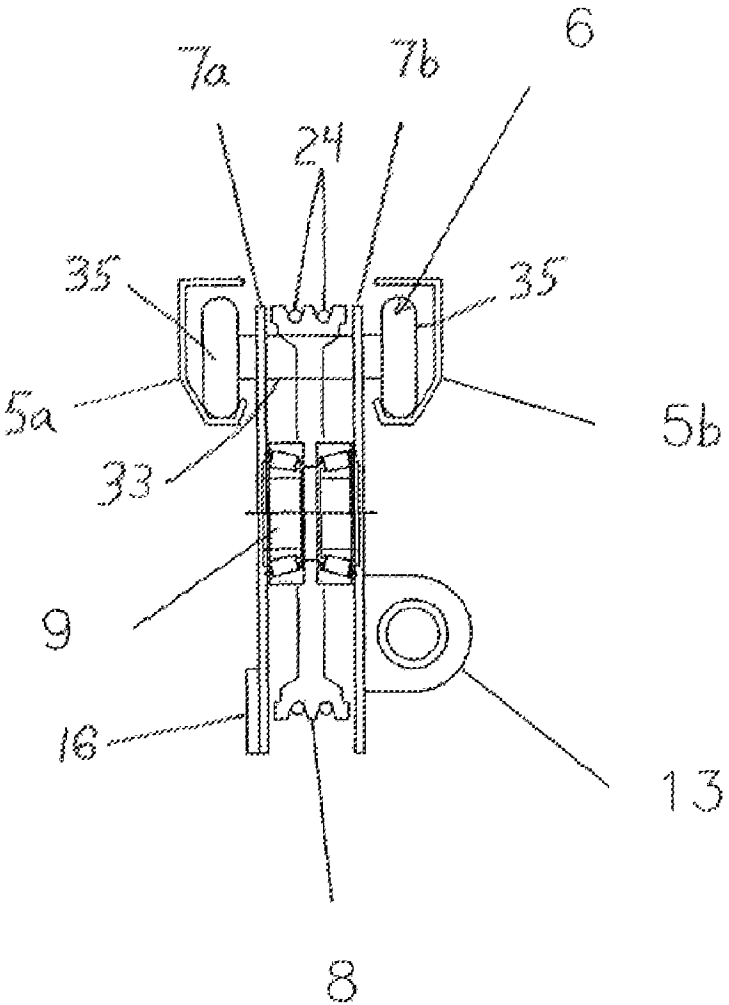
FIG. 7 is a front elevation view of the housing of FIG. 6.
Figure 6:
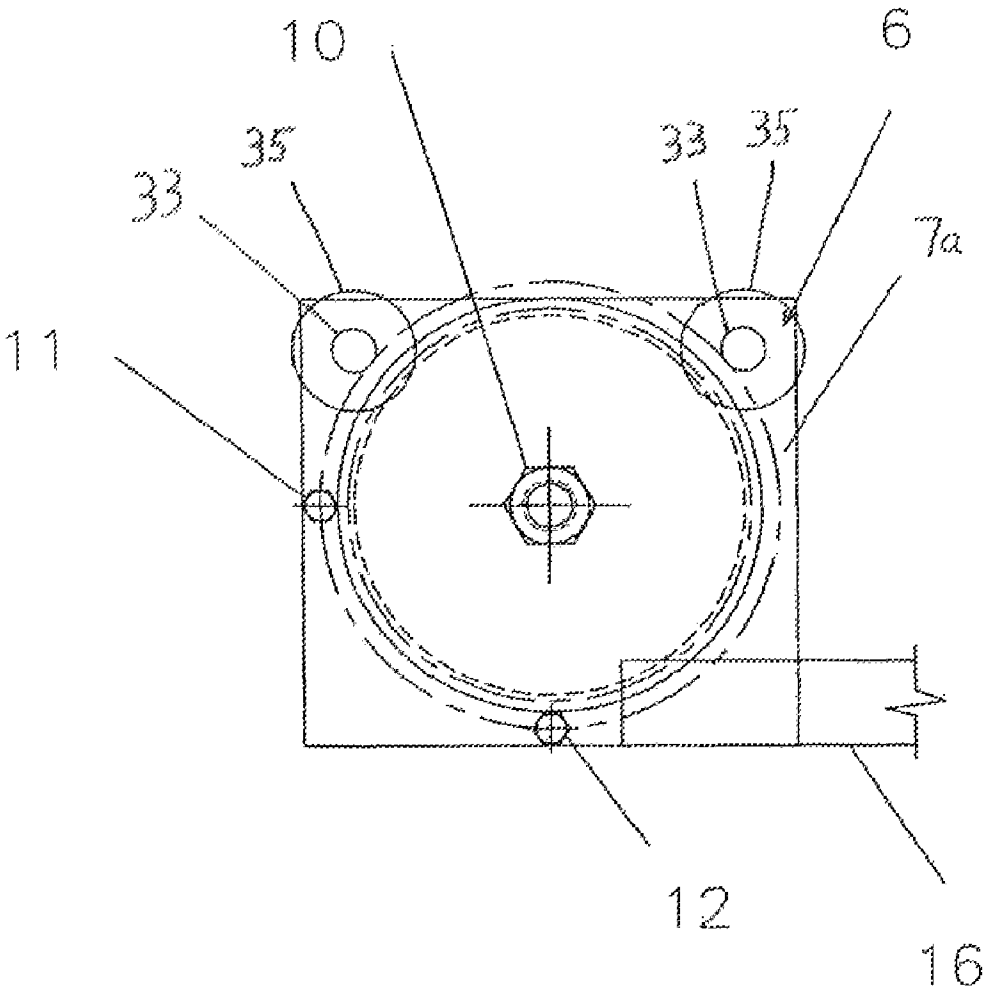
FIG. 6 is a side elevation view of a drive/hitch head block housing.
Figure 10:
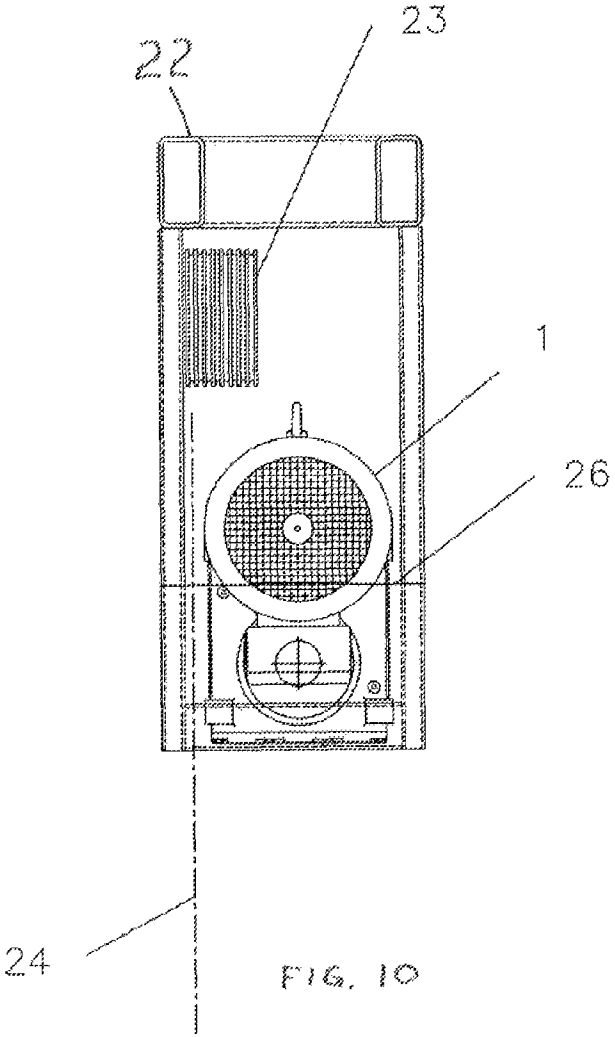
FIG. 10 is a forward end view of the hoist of FIG. 1.

To avoid interference between the cables 24 as the cables are turned horizontally around the head block sheaves 8, the head block guides 6 are attached at progressively higher elevations on the head block 7, causing the head block sheaves 8 to be positioned progressively lower and thus avoid interference between the cables. Referring to FIG. 1 the head block guide 6 on head block 14 is positioned such that the sheave of head block 14 has the highest cables. The head block guide 6, on head block 15 such that the sheave is positioned at a lower elevation than the sheave of head block 14. A detailed illustration of head block 14 as shown in FIG. 4 depicts the head block guide 6 positioned on the side plates 7*a* and 7*b*. The head block guide 6 on head block 15 is positioned higher on the side plates 7*a* and 7*b* as shown in FIG. 6. Furthermore, the head blocks of the present disclosure are staggered in height with respect to each other as shown in FIGS. 11-14.

A drive screw transfer block assembly 13 is attached to the housing of head blocks 14 and 15. The transfer block assembly 13 engages the screw threads on the drive screw 19 to move the head block. The drive screw 19 in cooperation with the drive screw transfer block assembly 13 on each of head blocks 14 and 15 are designed to substantially align the head blocks with the take-off points on the drum 2 where the cables 24 are wound or unwound. In doing so, the fleet angle is maintained essentially at zero and, therefore, is minimized to reduce wear on the cables and drum.

A head block transfer arm 16 may be included for embodiments having multiple drums 2, and therefore multiple sets of head blocks. Head block transfer arm 16 is attached to head block 15 which also has a drive screw transfer block assembly 13 for engagement with the head block drive screw 19. The linear motion imparted to head block 15 by the drive screw 19 is also imparted to head blocks 17 and 18, which are connected to the transfer arm 16.

Referring again to FIG. 1, brake assembly 21 may be attached to the drive shaft 4. The brake assembly 21 cooperates with a shaft sensor 30 to prevent a load from inadvertently falling. The shaft sensor 30 receives input data related to the rotation of the drive shaft 4. If the drive shaft rotation is outside a predetermined limit, the brake 21 will engage to stop and lock the drive shaft 4. The normal operation of the brake 21 uses a spring to engage the brake disk when de-energized and to release when energized. In this manner the brake 21 will operate in a fail-safe mode, preventing the load from falling upon loss of power to the brake.

Each of the cables 24 leaves the drum 2 and passes about an associated head block sheave 8. The head block sheaves 8 guide the cables 24 and turn each cable 24 from a vertical orientation to a horizontal orientation. Each of the cables then runs horizontally back towards the motor end of the hoist assembly 31. At the motor end of the assembly is a master head block 23 that aligns all the cables horizontally so that the cables do not interfere with each other. In another embodiment of the disclosure, the master head block may act as a diverter block or combination block to horizontally align some of the cables and redirect some of the cables vertically in the direction of the load.

In an alternate embodiment, the drive head block may be positioned to receive the lifting cables 27 from the drum and turn them towards the aft end of the assembly, see FIG. 3. For this embodiment, a secondary diverter block 28 is added to the assembly. The secondary diverter block 28 receives the lifting cable from the drive head block sheave and directs the cable in a vertical direction towards the load.

While an embodiment has been illustrated and described in the drawings and foregoing description, such illustrations and descriptions are considered to be exemplary and not restrictive in character, it being understood that only an illustrative embodiment has been shown and described and that all changes and modifications that come within the spirit of the invention are desired to be protected. The applicant has provided description and figures which are intended as an illustration of certain embodiments of the disclosure, and are not intended to be construed as containing or implying limitation of the disclosure to those embodiments. There are several advantages of the present disclosure arising from various features set forth in the description. It will be noted that alternative embodiment of the disclosure may not include all of the features described yet still benefit from at least some of the advantages of such features. Those of ordinary skill in the art may readily devise their own implementations of the disclosure and associated methods that incorporate one or more of the feature of the disclosure and fall within the spirit and scope of the present disclosure as defined by the impendent claims.

I claim:

1. A hoist assembly for raising and lowering a load attached to a plurality of cables comprising:

a fixed frame detached from the load;

a stationary drum mounted within said frame, said drum configured for rotational motion and having an outer surface with a groove spirally disposed about said outer surface with a predetermined pitch, wherein said groove is configured to receive the plurality of cables wound about the drum, and having a cable take-off point associated with each cable where the cable ceases contacting said drum and where the cable is tangent to said drum, defining a fleet angle for each cable between the centerline of said groove and the cable;

a plurality of head blocks, each head block configured to receive at least one cable as said cable is wound and unwound on said drum, said head blocks configured to maintain tangential alignment of each of said plurality of cables with said associated take-off point, wherein said head block maintains said fleet angle of each cable at substantially zero degrees;

a head block guide assembly having a first head block guide track and a second head block guide track mounted on said frame spaced apart and parallel to each other; and at least one of said head blocks positioned between said first and second head block guide tracks, said at least one head block having a plurality of wheels disposed within said first and second head block guide tracks, wherein said at least one head block is free to move along said guide track; and said head blocks being mounted to said head block guide assembly allowing for synchronized translational movement of said head blocks relative to said stationary drum along said frame maintaining alignment with each take-off point.

2. The hoist assembly of claim 1 further comprising a drive shaft coupled to and configured to transmit rotational motion to said drum.

3. The hoist assembly of claim 2 further comprising:

a head block drive assembly coupled to said drive shaft; and a head block drive screw having the same pitch as said groove, wherein said head block drive screw coupled to said head block drive assembly, synchronizing said plurality of head blocks to said drive shaft maintaining each of said head block in tangential alignment with said associated take-off points.

4. The hoist assembly of claim 3 further comprising:

a gear motor coupled to a first end of said drive shaft; and wherein said head block drive assembly is coupled to a second end of said drive shaft, and wherein said drive shaft and said head block drive screw are positioned parallel to and spaced from each other.

5. The hoist assembly of claim 4 having a plurality of drums coupled to said drive shaft, each drum having an outer surface with at least one groove spirally disposed about said outer surface having a predetermined pitch, wherein said groove is configured to receive the cable wound about the drum, and having a cable take-off point where the cable ceases contacting said drum.

6. The hoist assembly of claim 1 wherein said drum has a plurality of grooves spirally disposed about said outer surface, each groove having the same predetermined pitch, wherein said grooves are configured to each receive a cable wound about the drum, and each groove having a cable take-off point where the cable ceases contacting said drum, wherein the fleet angle of each cable is substantially zero degrees.

7. The hoist assembly of claim 1 wherein said drum includes a plurality of adjacent grooves spirally disposed about said outer surface, each groove having the same predetermined pitch, wherein said adjacent grooves are configured to each receive a cable wound about the drum, each groove having an associated cable take-off point where the cable ceases contacting the drum; and a head block configured to receive said cables from each of the plurality of grooves to maintain substantially tangential alignment of each cable with said associated take-off point, wherein the fleet angle of each cable is substantially zero degrees.

8. A hoist assembly for raising and lowering a load attached to a plurality of cables comprising:

a fixed frame detached from the load having a first end and a second end and a plurality of support members;

a plurality of head blocks, each head block having a sheave for receiving and directing at least one cable as it is wound and unwound about a stationary drum configured for rotational motion, said sheave being disposed within a head block housing including a plurality of wheels mounted on said head block housing;

a head block guide assembly including a first guide track and a second guide track, said guide tracks being attached to said frame in a substantially parallel spaced apart configuration, said head block housing being positioned between said first and second guide tracks, each track comprising a channel for receiving said wheels attached to said head block, wherein said wheels are disposed within the head block guide assembly;

a drive member mounted at said first end of said frame;

a drive shaft coupled to said drive member;

said stationary drum coupled to said drive shaft and having an outer surface with a groove spirally disposed about said outer surface having a predetermined pitch, wherein said groove is configured to receive at least one of said plurality of cables wound about the drum, and having a cable take-off point where the cable ceases contacting said drum, defining a fleet angle for said at least one cable between the centerline of said groove and the cable;

a head block drive assembly mounted on said frame at said second end coupled to said drive shaft opposite said drive member;

a head block drive screw having the same pitch as the drum, coupled to said head block drive assembly and coupled to said head block;

wherein said head block drive screw is configured to maintain said head block aligned with said take-off point, and wherein said fleet angle is substantially zero degrees.

9. The hoist assembly of claim 8 wherein said drive member comprises a gear motor.

10. The hoist assembly of claim 8 wherein said drum includes a plurality of adjacent grooves spirally disposed about said outer surface, each groove having the same predetermined pitch, wherein said adjacent grooves are configured to each receive a cable wound about the drum, each groove having an associated cable take-off point where the cable ceases contacting the drum; and a head block configured to receive said cables from each of the plurality of grooves to maintain substantially tangential alignment of each cable with said associated take-off point, wherein the fleet angle of each cable is substantially zero degrees.

* * * * *